US005913400A

United States Patent [19]

Farmont

[11] Patent Number: 5,913,400

[45] Date of Patent: Jun. 22, 1999

[54] ENTRANCE-CONTROL AND DEPARTURE-CONTROL STATION FOR CHARGE-RELATED CAR PARK

[75] Inventor: Hans Farmont, Ratingen, Germany

[73] Assignee: Farmont Technik GmbH & Co., Dusseldorf, Germany

[21] Appl. No.: 08/787,988

[22] Filed: Jan. 23, 1997

[51] Int. Cl.[6] ..... G07F 7/00

[52] U.S. Cl. ..... 194/210; 194/902; 235/384

[58] Field of Search ..... 194/205, 210, 194/213, 901, 902; 235/384; 340/932.2; 453/56, 57

[56] References Cited

U.S. PATENT DOCUMENTS

| | | | |
|---|---|---|---|
| 4,319,674 | 3/1982 | Riggs et al. | 194/210 |
| 4,342,384 | 8/1982 | Fukase et al. | 453/56 X |
| 5,500,515 | 3/1996 | Farmont | 194/902 X |

FOREIGN PATENT DOCUMENTS

| | | |
|---|---|---|
| 2266229 | 3/1974 | France . |
| 94 07 260 U | 4/1994 | Germany . |

*Primary Examiner*—F. J. Bartuska

*Attorney, Agent, or Firm*—Flehr Hohbach Test Albritton & Herbert, LLP; Steven F. Caserza

[57] ABSTRACT

An entrance-control and departure-control station in which the return of the used car-park tickets to the entrance-side issuing apparatus is automated. The issuing apparatus of the entrance-control station are connected to one another via a car-park-ticket-return device. The car-park tickets which are to be returned are moved, in a pushed group, through a transporting duct which bridges a spatial distance between the issuing apparatus and the retrieval apparatus. In addition to the spatial distance bridged, a vertical ascent is also surmounted, in order that the retrieved car-park tickets running in under the action of gravity are brought once again to a higher level, from where they can be discharged again as required under the action of gravity during an issuing operation.

60 Claims, 6 Drawing Sheets

ENTRANCE-CONTROL AND DEPARTURE-CONTROL STATION FOR CHARGE-RELATED CAR PARK

FIELD OF THE INVENTION

The invention relates to an entrance-control and departure-control station for charge-related car parks, having an entrance-side issuing apparatus for disc-shaped car-park tickets and a departure-side retrieval apparatus for the same, having in each case one read device assigned to the issuing apparatus and to the retrieval apparatus, and having at least one control device for issuing car-park tickets to the user and retrieving them from the user.

PRIOR ART

Upon entrance into charge-related multi-storey car parks or charge-related open-air car parks, the users are issued with disc-shaped car-park tickets which are used for billing parking and, in general, also for actuating a departure barrier at the end of a parking period. The issuing of car-park tickets, which is necessary for this purpose, in the entrance region requires an issuing apparatus to be set up, the latter storing the car-park tickets and issuing them to a car-park user upon request at the beginning of a parking period. If the car park tickets are car-park tickets which can be issued repeatedly and have an identification and/or communication element, then the individual car-park tickets which have been used and returned into the departure-side retrieval apparatus are collected there in a retrieval container. As soon as the retrieval container is full or is filled with a predetermined quantity of car-park tickets, this container is emptied manually and the car park tickets obtained are introduced anew into the supply container of the entrance-side issuing apparatus.

It is also only the case that this refilling operation involves a high degree of outlay and has to be constantly repeated; it is also the case that this operation frequently also has to be carried out with insufficient coordination with the entrance-side issuing apparatus, with the result that the latter may run out of car-park tickets, thus preventing entrance into a car park.

The object of the invention is thus to provide an entrance-control and departure-control station which simplifies the return of used car-park tickets for renewed issuing and avoids the situation where the entrance-side issuing apparatus runs out of car-park tickets.

SUMMARY

This invention provides an entrance-control and departure-control station in which the return of the used car-park tickets to the entrance-side issuing apparatus is automated. For this purpose, the issuing apparatus of the entrance-control station and retrieval apparatus of the departure-control station are connected to one another via a car-park-ticket-return device which does not require high-outlay transporting and conveying means. The car-park tickets which are to be returned are moved, in a pushed group, through a transporting duct which bridges a spatial distance between the issuing apparatus and the retrieval apparatus. In addition to the spatial distance bridged, a vertical ascent is also surmounted, in order that the retrieved car-park tickets running in under the action of gravity are brought once again to a higher level, from where they can be discharged again as required under the action of gravity during an issuing operation.

Since the re-issuable car-park tickets do not consist of paper, but of an essentially stiff or rigid material, in particular plastic, good transmission of pushing force is achieved. This is further improved if, on account of greater thickness or a special border configuration, the car-park tickets have a wider circumferential surface, which serves as a pushing contact surface. The circumferential surface of the car-park tickets preferably has a width of from 2 to 8 mm. Furthermore, if use is made of disc-shaped round car-park tickets, then a pushed group of car-park tickets which are in contact with one another via the circumferential surfaces can be formed, which group can move forwards while simultaneously utilizing the rolling capacity of the car-park tickets.

The car-park-ticket-return device may be installed in a combined entrance-control and departure-control station or, if the entrance-control station is separate from the departure-control station, can be installed in either station, in conjunction with possibly additional connecting duct, or else in the two stations in each case. If the entrance-control and departure-control stations are spaced apart, the ascending section may be utilized as at least part of a transfer duct between the entrance-control and departure-control stations.

Since car-park-ticket retrieval generally does not take place synchronously with the issuing of car-park tickets, the car-park-ticket-return device may comprise buffer or supply containers or shafts from, or into, which the pushing device conveys. The issuing apparatus may thus be supplied with car-park tickets for a required issuing operation separately from an individual car park ticket retrieval operation. Alternatively or in addition, either there may be arranged upstream of the issuing apparatus a supply container or duct, into which the car park-ticket-retrieval device conveys, and/or there may be arranged downstream of the retrieval apparatus such a supply container or duct, from which the car park ticket return device may then convey.

The issuing apparatus and retrieval apparatus may each comprise a downwardly directed shaft along which a read and, if appropriate, communication device are arranged in each case. A barrier for temporarily retaining a car-park ticket in this read and, if appropriate, communication region may further be provided in order to render the stay time of a car-park ticket in this functional region longer. The detection of retrieval and issuing of car-park tickets can be linked to the actuation of a parking barrier by means of the at least one control device. Furthermore, the control device can control the operation of the pushing device in dependence on the issuing or retrieval of a car-park ticket.

Configuring the pushing device as a driving plate makes it possible for the pushing device not only to move the car-park ticket forwards, but also to separate them beforehand. Additional separating devices are consequently avoided. The result is a simple and additionally low-maintenance design. Furthermore, guide webs may be provided on the driving plate such that car-park tickets conveyed out in an ascending shaft are retained by being supported, to be precise until a subsequently conveyed car-park ticket is moved forwards, by way of the pushing device, into the ascending shaft and moves forwards the car-park tickets located therein. This configuration permits a simple design as well.

Further configurations of the invention can be gathered from the following description and from the claims.

BRIEF DESCRIPTION OF THE DRAWINGS

The invention is explained in more detail hereinbelow with reference to the exemplary embodiments illustrated in the accompanying drawings, in which.

DETAILED DESCRIPTION

Figure 1B:
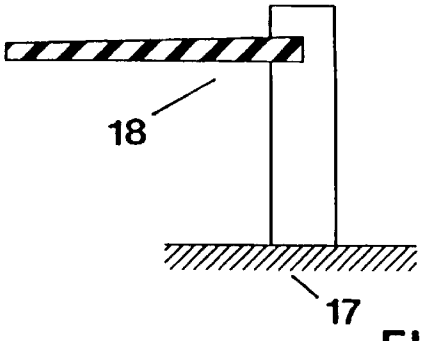
FIG. 1*b* shows, schematically, a parking barrier which can be connected up to the entrance-control and departure-control station according to FIG. 1*a,*

The first exemplary embodiment, which is illustrated in FIG. 1, of an entrance-control and departure control station for charge-related car parks comprises an entrance-control station 1 and a departure-control station 2 which are installed in a common housing 3 or in adjacent housings. Accordingly, the first exemplary embodiment relates to a combined entrance-control and departure-control station which issues and retrieves reusable car-park tickets 4.

The car-park tickets 4 are disc-shaped car-park tickets consisting of an essentially stiff or rigid material, in particular plastic. It is possible to select the outer configuration of the car-park tickets 4. However, round car-park tickets 4 are preferred since the rolling capacity thereof improves the conveyability. The thickness of the car-park tickets 4, or their border configuration, is selected such that the car-park tickets have a circumferential running and contact surface which has a width of approximately 2 to 8 mm. Furthermore, an identification element and, if appropriate, a communication element with a selectable code, which can be read by the entrance-control and departure-control station, are integrated in the car-park tickets 4.

The departure-control station 2 comprises a departure-side retrieval apparatus 5 which comprises a downwardly directed shaft 6. The downwardly directed shaft 6 extends from a car-park-ticket-collection opening 7, which is located in a departure-side housing wall 8, and is of such dimensions that the car-park tickets 4 can roll or slide down the downwardly directed shaft 6 on their circumferential surface and cannot fall over out of this position. A base surface 9 of the downwardly directed shaft 6 then forms a running surface for the car-park tickets 4.

Provided at an initial section 10 of the downwardly directed shaft 6 is a read and, if appropriate, communication device 11 by means of which a car-park ticket 4 which has been introduced through the collection opening 7 by a departing car-park user can be read and, if appropriate, recorded on. The read and, if appropriate, communication device 11 may be formed, in a known manner, by a read head, if appropriate combined with a write head. The read and, if appropriate, communication device 11 is connected to a control device 12 which processes the read values for activating further devices which may be connected to the control device 11.

Provided downstream of the location where the read and, if appropriate, communication device 11 is arranged is a blocking device 13 by means of which the downwardly directed shaft 6 can be closed or released in order to retain the car-park tickets 4 for a selectable time span in the range of action of the read and, if appropriate, communication device 11. The directions in which the blocking device 13 can be displaced are marked by a double arrow. The position of the blocking device 13 in the release position is illustrated by dashed lines and the position of the blocking device 13 in the blocking position is illustrated by solid lines. For actuating the blocking device 13, the latter is connected to the control device 12.

Furthermore, the retrieval apparatus 5 may comprise a downwardly directed reject shaft 14, which branches off from the downwardly directed shaft 6 downstream of the read and, if appropriate, communication device 11 and runs to a reject opening 15 in the departure-side housing wall 8. Car-park tickets 4 which are not authorized for departure by the read and, if appropriate, communication device 11 can be given back to a car-park user via said downwardly directed reject shaft 14. For redirecting a car-park ticket 4 which has been introduced into the downwardly directed shaft 6, there is provided in said downwardly directly reject shaft 14 a rocker or a transverse pin 16 whose region for pivoting into and out of the downwardly directed shaft 6 is marked by a double arrow. The actuation of the rocker 16 is triggered via the control device 12, for which reason it is connected to the control device 12.

Furthermore, a parking barrier 18 (cf. FIG. 1*b*) which crosses a roadway 17 may also be connected to the control device 12 in order to be opened and closed. The control device may further be connected to a pay station (not shown) in order for the latter to signal departure authorization for a car-park ticket 4, in particular identified by its code.

Arranged downstream of the retrieval apparatus 5 is at least one pushing device 19, which is associated with a car-park-ticket-return device 20 which connects the retrieval apparatus 5 to an entrance-side issuing apparatus 40. In addition to the at least one pushing device 19, the car-park-ticket-return device 20 comprises a transporting duct 21, of which an inlet 22 adjoins an outlet 23 of the pushing device 19 and an outlet 24 adjoins the entrance-side issuing apparatus 40. Since the downwardly directed shaft 6 adjoins the pushing device 19 and thus feeds to the pushing device the car-park tickets 4 which have been returned by the car-park users, said pushing device 19 can convey the received packing tickets 4 into the transporting duct 21, which directs the car-park tickets to the entrance-side issuing apparatus 40.

Figure 1C:
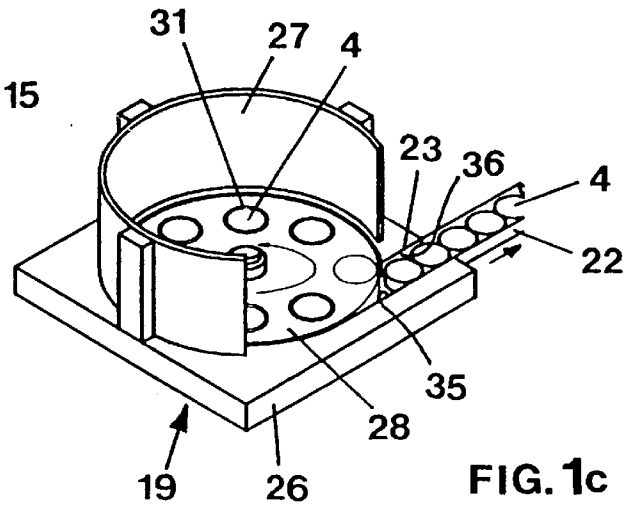
FIG. 1*c* shows, schematically, a lateral front view of the pushing device according FIG. 1*a,*

The pushing device 19 is preferably formed by a driving plate, as is illustrated in FIG. 1*c*. The driving plate comprises a combined car-park-ticket-separating and driving device 26 and a supply container 27 which is positioned thereon and is intended for receiving a plurality of car-park tickets 4. The car-park-ticket separating and driving device 26 forms a base of the supply container 27. The car-park-ticket-separating and driving device comprises a car-park-ticket-fishing disc which is formed by a perforated disc 28 (see FIGS. 4 and 5) which is mounted rotatably over a guide path 29 (see FIGS. 6 and 7) and can be driven in a continuous or stepwise manner by means of a motor 30.

Figure 4:
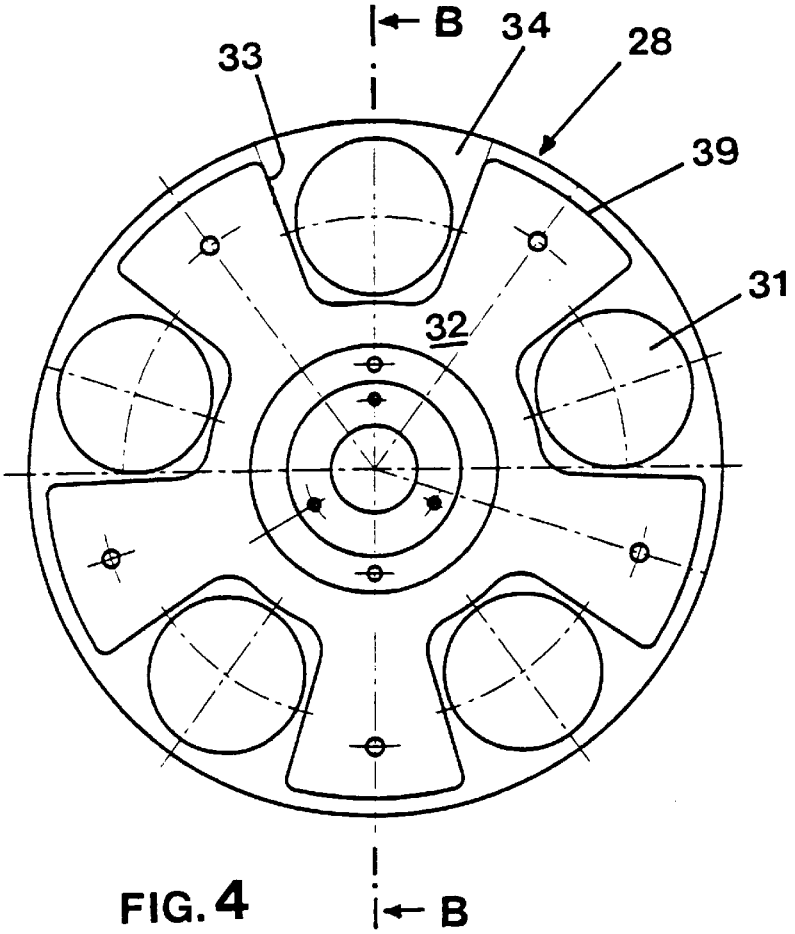
FIG. 4 shows a bottom view of a car-park-ticket-intercepting and driving disc.
Figure 5:
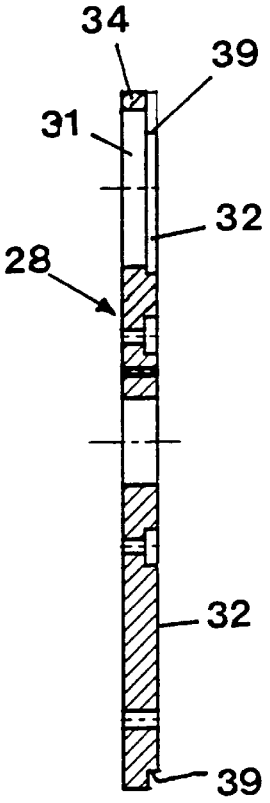
FIG. 5 shows a section along B—B of FIG. 4.

As can be seen from FIGS. 1*c*, 4 and 5, the perforated disc 28 has a plurality of concentrically arranged holes 31. Since, in accordance with the exemplary embodiment described, use of made of round car-park tickets 4, the holes 31 are round cutouts, the diameter of which slightly exceeds the diameter of the car-park tickets 4 in order that the latter can slide into the holes 31 and can drop through these into the guide path 29 located therebeneath. The perforated disc 28 according to FIG. 1*c* differs from the perforated disc 28 according to FIG. 4 in terms of the number of holes 31. The perforated discs 28 are otherwise of the same design, so, as far as a detailed description is concerned, you are referred to the perforated disc 28 illustrated in FIGS. 4 and 5.

In addition to a number of holes 31, the perforated disc 28 has guide webs 32 which project on the rear side and by means of which the perforated disc 28 engages in the guide path 29. The guide path 29, which is formed by a curved groove which follows the circle of the concentrically arranged holes 31, has a depth which is matched to the thickness of the car-park tickets 4, to be precise such that the car-park tickets 4 are received by it in such a manner that the car-park tickets 4 which have dropped in are only gripped by the guide webs 32, and thus a perforated-disc plate 34 from which the guide webs 32 project on the rear side can move over car-park tickets 4 guided in the guide path 29.

The guide webs 32 enclose each hole 31 in a mouth-like manner by means of a circumferential mouth opening 33, through which a car-park ticket 4 can be discharged. Accordingly, a car-park ticket 4 intercepted by a hole 31 drops through the hole 31 into the guide path 29 arranged therebeneath and, as the perforated disc 28 rotates in the direction of an outlet 23, is retained in the region of the respective hole 31 by the guide webs 32, enclosing the respective hole 31 in a mouth-like manner, and moved along. The direction of rotation depends on the selectable direction of the outlets 23.

Figure 6:
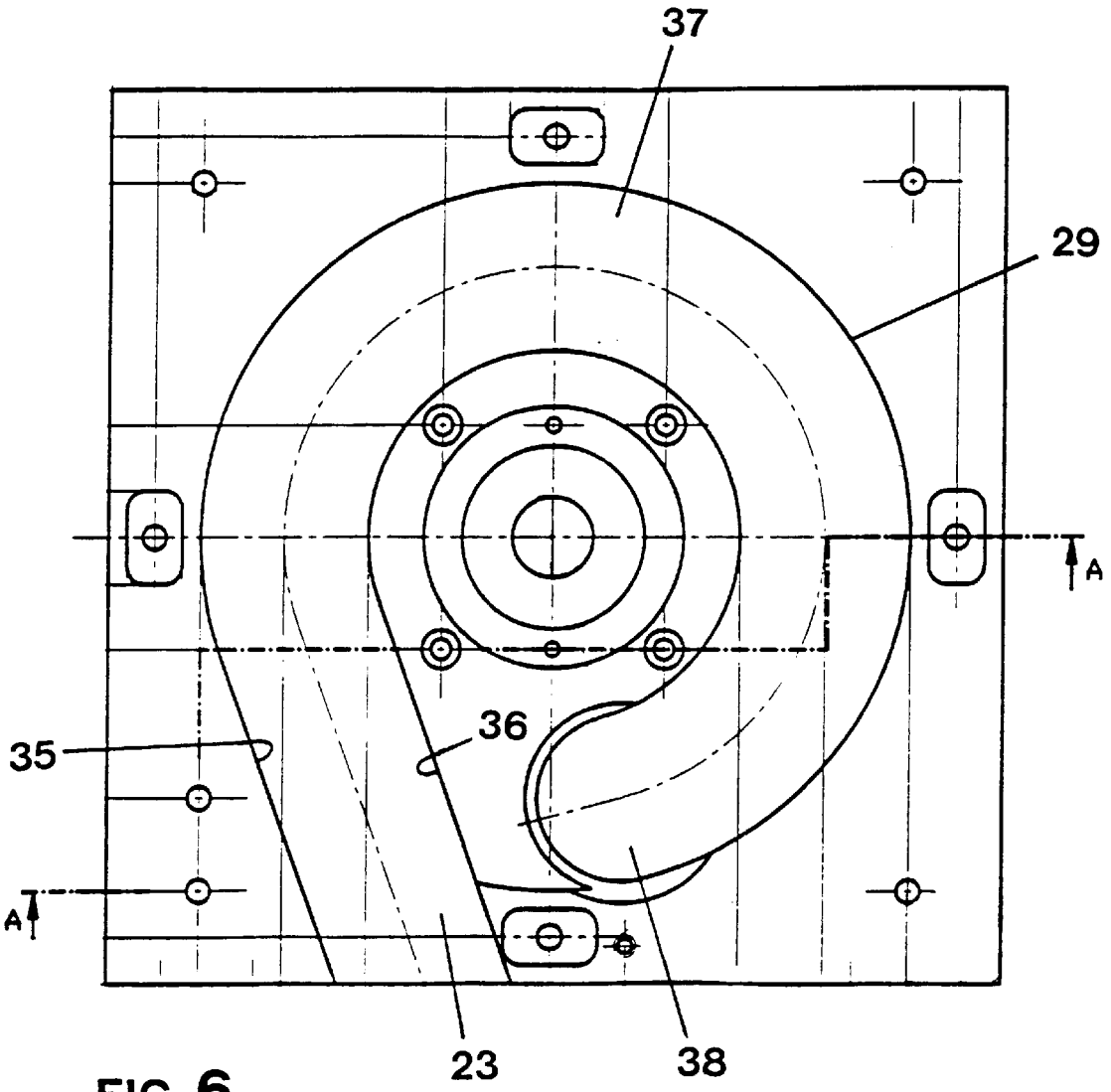
FIG. 6 shows a plan view of a guide path of a pushing device which interacts with a car-park-ticket intercepting and driving disc according to FIG. 4.
Figure 7:
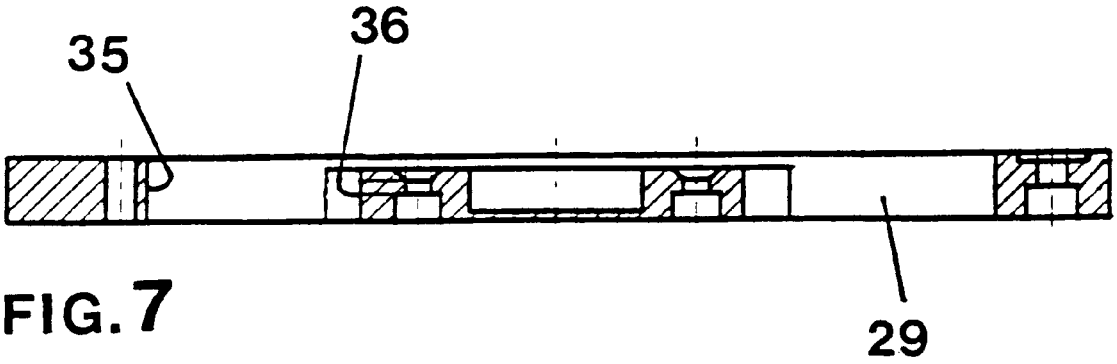
FIG. 7 shows a section along A—A of FIG. 6.

As is illustrated in FIGS. 1*c* and 6, the guide path 29 ends in an outlet 23 which is formed by a curved outlet and forms a discharge, which is rectilinear here. This outlet 23 has lateral delimiting borders 35, 36 for positively guiding into the outlet 23 the car-park tickets running in the guide path 29. On account of the rotary movement of the perforated disc 28 and the positive guidance into the outlet 23, the car-park tickets 4 running in the guide path are moved out of the perforated disc 28 through the mouth opening 33.

The guide path 29 thus has a loop-shaped configuration, an arc 37 of the loop being arranged on the arc of the circular arrangement of the holes 31, and a dead end 38 being provided at a selectable loop-arc section, said dead end 38 being selected such that the arc 37, which constitutes the intercepting section for the car-park tickets 4 in the supply container 27 and thus ensures the separation of the car-park tickets 4, is as long as possible. According to FIG. 6, the dead end 38 is adjacent to the outlet 23.

As is illustrated in FIGS. 4 and 5, the guide webs 32 which project from the rear side not only enclose the holes 31 in a mouth-like manner, but also comprise border-side, second guide webs 39 which run, parallel to the circumferential surface, between two mouth openings 34 in each case. These second guide webs 39 form pushing and supporting surfaces for in each case one car-park ticket 4 conveyed into the outlet 23 by the perforated disc 28.

As can be seen, in particular, from FIG. 1*c*, the perforated disc 28 moves the car-park tickets 4 one after the other into the outlet 23 and from there into the transporting duct 21. The second guide webs 39 have the effect that, as the perforated disc 28 continues to rotate, a car-park ticket 4 which has been moved into the outlet 23 is pushed forwards and also supported in the process. As soon as the perforated disc 28 moves the next car-park ticket 4 into the outlet, this car-park ticket 4 which has just newly passed into the outlet 23 exerts a pushing movement on the car-park tickets 4 which are already located in the outlet and is itself conveyed through the outlet by the second guide webs 39. A pushed group 41 comprising car-park tickets 4 located loosely one behind the other under the action of gravity is thus formed in the outlet 23 and the adjoining transporting duct 21, the respectively last car-park ticket 4 conveyed into the outlet 23 by the perforated disc 28 forming the lowermost car-park ticket of a series of car-park tickets 4, which lowermost car-park ticket transmits the pushing movement to the pushed group 41 of car-park tickets 4 in the transporting duct 21, i.e. the forwards movement of the lowermost car-park ticket moves the entire pushed group 41 forwards by the length of one car-park ticket 4. Consequently, a car-park-ticket stream is conveyed through the transporting duct 21. The direction of movement of the pushed group 41 is illustrated by an arrow in FIG. 1*c*.

Figure 1A:
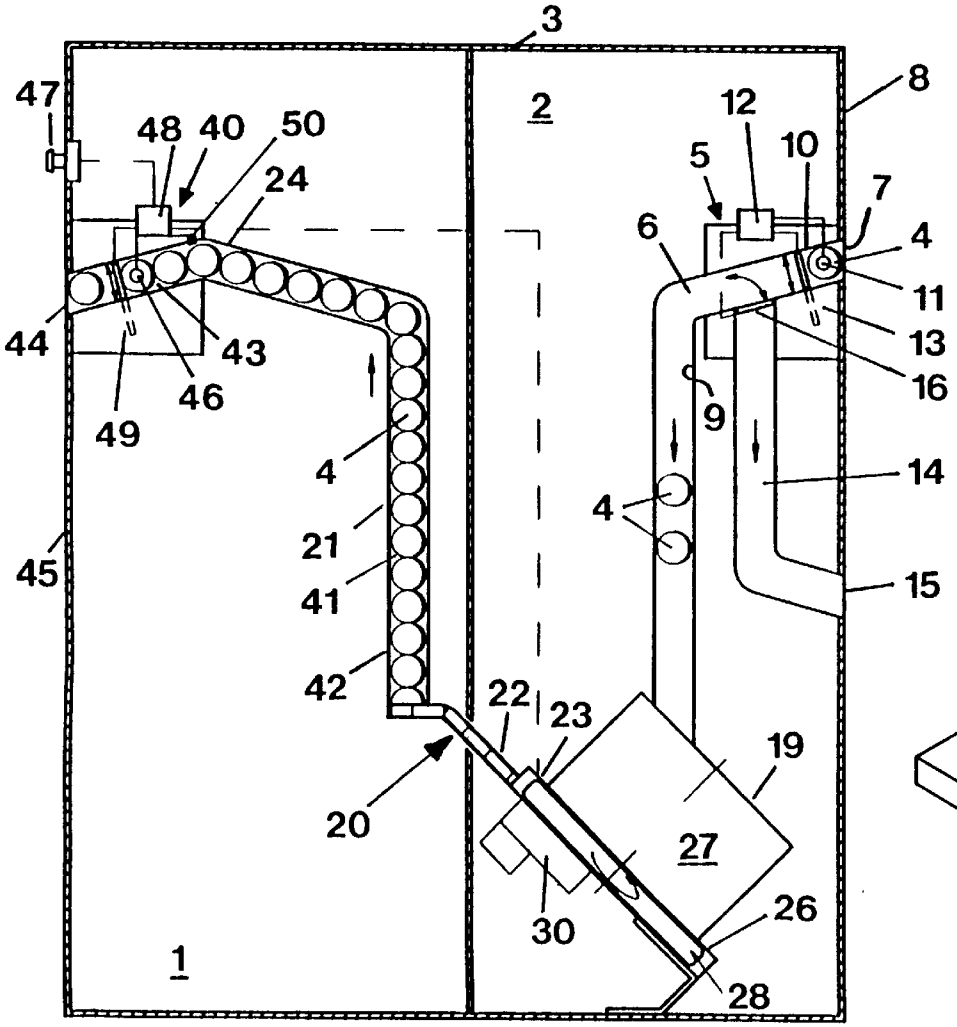
FIG. 1*a* shows, schematically and partially in section, a front view of a first exemplary embodiment of an entrance-control and departure-control station.

It is advantageous here if the pushing device 19 has a perforated disc 28 which is set up in an obliquely upright manner, as illustrated in FIG. 1*a*. This facilitates the fishing of the car-park tickets 4 by the perforated disc 28, and thus the separation of said car-park tickets 4. Furthermore, the outlet 23 may be arranged at the top of the pushing device 19 and form a type of downwardly directed shaft, which improves the structure of the pushed group 41.

The transporting duct 21 adjoining the pushing device 19 adjoins the outlet 23 of the pushing device 19, in which the pushed group 41 moves forwards, by means of at least one ascending section 42. The vertical ascent achieved by the ascending section is preferably selected such that the outlet 24 of the transporting duct transfers the returned car-park tickets 4 to the issuing apparatus 40 at a level at which the car-park tickets 4 can be issued via a downwardly directed shaft 43 provided in the issuing apparatus 40. Said downwardly directed shaft 43 ends in an issuing opening 44 in the entrance side housing wall 45, the issuing opening 44 and the retrieval opening 7 preferably being located at the same, user-friendly level.

The cross-section of the transporting duct 21 is selected such that the latter guides the car-park tickets in an upright, rollable position, as is illustrated in FIG. 1*a*. It is possible to select the length of the transporting duct 21, it being possible to combine sections with different vertical ascents. Curved sections may also be included.

Similarly to the retrieval apparatus 5, the issuing apparatus 40 is equipped with a read and, if appropriate, communication device 46 by means of which a car-park ticket 4 which is to be issued to an entering car-park user by the actuation of a request button 47 is read and, if appropriate, recorded on. The read and, if appropriate communication device 46 may be formed, in a known manner, by a read head, if appropriate combined with a write head. The read and, if appropriate, communication device 46 is connected to a control device 48 which processes the read values for activating further devices which may be connected to the control device 48.

Provided downstream of the location where the read and, if appropriate, communication device 46 is arranged is a blocking device 49 by means of which the downwardly directed shaft 43 can be closed or released in order to issue a car-park ticket 4 in each case only upon request. The direction in which the blocking device 49 can be displaced is marked by a double arrow. The position of the blocking device 49 in the release position is illustrated by dashed lines and the position of the blocking device 49 in the blocking position is illustrated by solid lines. For actuating the blocking device 49, the latter is connected to the control device 48.

The control devices 12, 48 may be combined to give a common control device. In addition, the drive 30 for actuating the pushing device 19 is connected to at least one control device 12, 48, preferably the control device 48 of the issuing apparatus 40. The pushing device 19 may be activated, and new car-park tickets returned from the retrieval apparatus 5 to the issuing apparatus 14, as required and in dependence on the filling level in the issuing apparatus 40, in particular in the downwardly directed shaft 43. For this purpose, a filling-level monitor 50, which is likewise connected to the control device 48, may be provided in the downwardly directed shaft 43 of the issuing apparatus 40. The operations of retrieving the car-park tickets 4, returning the latter by the operation of the pushing device 19 and issuing the car-park tickets can be coordinated with one another such that the car-park tickets 4 pass through continuously. The interposition of buffer sections and/or supply containers, in particular supply container 27 of the pushing device 19, increases the flexibility of the system.

The connections of the control devices 12, 48 to the various components described above are illustrated by dashed lines.

In accordance with a development of the first exemplary embodiment of FIGS. 1*a* to 1*c*, there may be arranged upstream of the issuing apparatus 40 a supply container into which the car-park-ticket-return device 20 conveys and from which the issuing apparatus 40 removes car-park tickets to be issued as required.

The above-described entrance-control and departure-control station operates as follows: a car-park user who wishes to drive out at the end of a parking period introduces into the departure collection opening 7 his or her car-park ticket 4 which has been authorized for departure, as a result of which this ticket 4 passes into the downwardly directed shaft 6 of the retrieval apparatus 5. The car-park ticket 4, in particular its code, is read at the read and, if appropriate, communication device. If a control device 12 is provided with a departure authorization for this code, then the parking barrier 18 is opened and the retrieved car-park ticket 4 drops, via the downwardly directed shaft 6, into the pushing device, to be precise first of all into the supply container 27, which is positioned on said pushing device and at which the downwardly directed shaft 6 ends.

If required, car-park tickets which have been retrieved from this supply container 27 of the car-park-ticket-return device 20 are separated and fed to the issuing apparatus 40 in a pushed group which can be moved forwards, a vertical difference being surmounted in the process, and the returned car-park tickets 4 can be issued again from said issuing apparatus 40 as required.

Figure 2B:
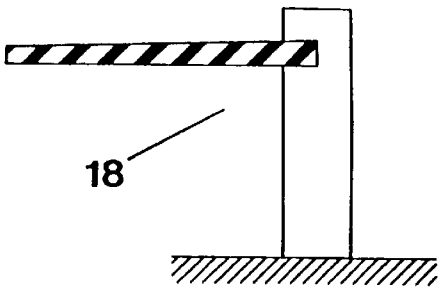
FIG. 2*b* shows, schematically, a parking barrier which can be connected up to the entrance-control and departure-control station according to FIG. 2*a,*
Figure 2C:
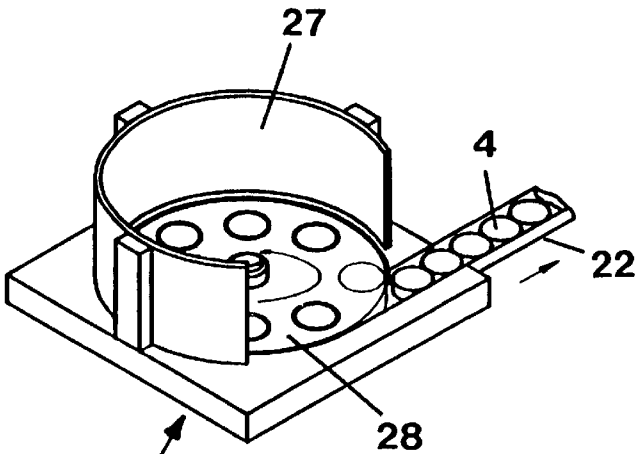
FIG. 2*c* shows, schematically, a lateral front view of the pushing device according FIG. 2*a,*
Figure 2A:
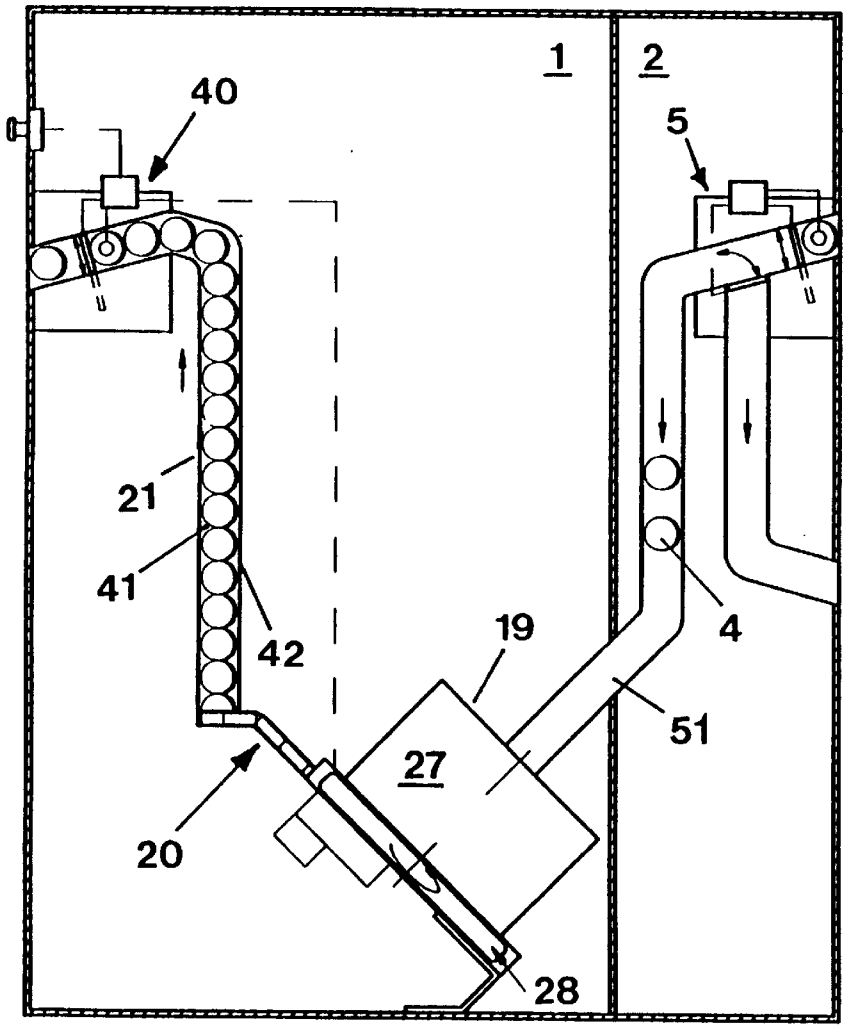
FIG. 2*a* shows, schematically and partially in section, a front view of a second exemplary embodiment of an entrance-control and departure-control station.

FIGS. 2*a* to 2*c* show a second exemplary embodiment of the entrance-control and departure-control station, the second exemplary embodiment differing from that described above only by the fact that the entrance-control station 1 can be set up separately from the departure-control station 2. The carpark-ticket-return device 20 with pushing device 19 and transporting duct 21 is then preferably installed in the entrance-control station 1. The connection between the retrieval apparatus 5 and the pushing device 19 is effected with the interposition of a connecting duct 51, which can bridge spatial distances between the entrance-control and departure-control stations. The connecting duct 51 preferably runs with a gradient from one station to the other station 1, 2, so that the car-park tickets 4 can be moved through the connecting duct 51 under the action of gravity alone.

The connecting duct 51 preferably has the same cross-section as the downwardly directed shaft 6 of the retrieval apparatus 5, the start of the connecting duct 51 adjoining said shaft 6. The end of the connecting shaft 51 adjoins the pushing device 19. Otherwise, the explanations for FIGS. 1*a* to 1*c* apply. The parking barrier 18 according to FIG. 1*b* and the pushing device 19 according to FIG. 1*c* correspond to those of FIGS. 2*b* and 2*c*.

Figure 3B:
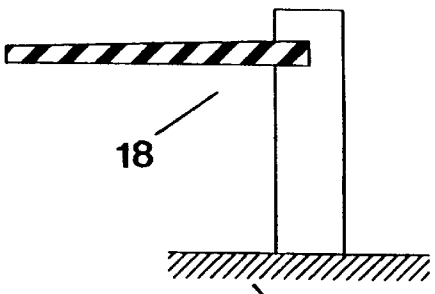
FIG. 3*b* shows, schematically, a parking barrier which can be connected up to the entrance-control and departure-control station according to FIG. 3*a,*
Figure 3C:
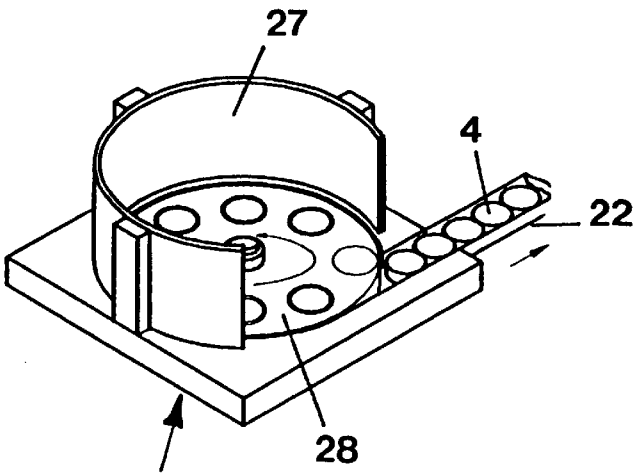
FIG. 3*c* shows, schematically, a lateral front view of the pushing device according FIG. 3*a,*
Figure 3A:
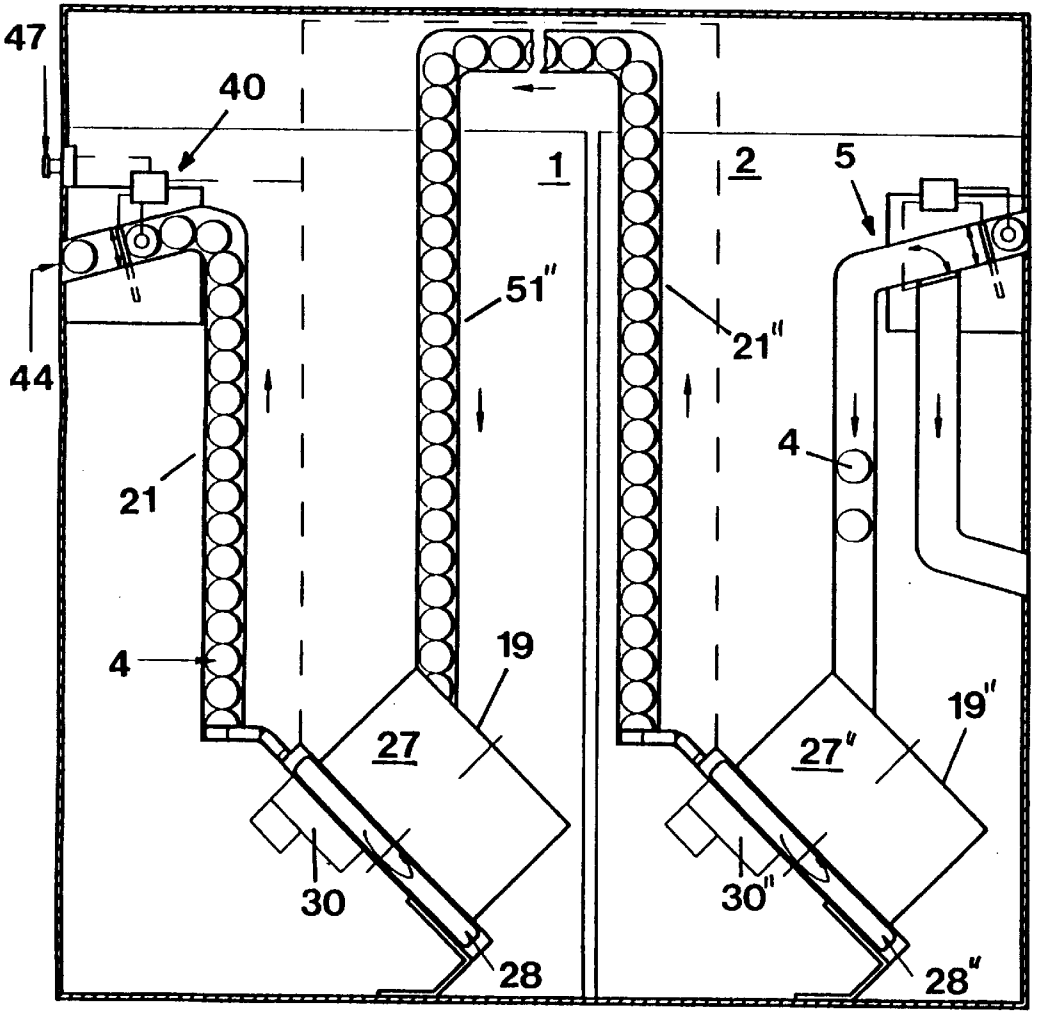
FIG. 3*a* shows, schematically and partially in section, a front view of a third exemplary embodiment of an entrance-control and departure-control station.

FIGS. 3*a* to 3*c* show a third exemplary embodiment of the entrance-control and departure-control station 1, 2, this third exemplary embodiment differing from the first exemplary embodiment according to FIGS. 1*a* to 1*c* by the fact that the entrance-control station 1 is separate from the departure-control station and, as in the second exemplary embodiment, an additional connecting device which bridges the spatial distance is provided. For this purpose, according to the third exemplary embodiment, the entrance-control station 1 and the departure-control station 2 are each equipped with a car-park-ticket-return device 20, 20" comprising pushing device 19, 19" and transporting duct 21, 21", the transporting duct 21" of the departure-control station adjoining the pushing device 19 of the entrance-control-station directly or with the interposition of an additional connecting duct 51". The spatial distance between the entrance-control station 1 and the departure-control station 2 is indicated by an interruption in the transporting duct 21". A drive 30" of the second pushing device 19" can be controlled via the control device 48 of the issuing apparatus 40. Otherwise, the explanations for FIGS. 1*a* to 1*c* apply correspondingly for the third exemplary embodiment according to FIGS. 3*a* to 3*c*. The components whose reference numerals have a double prime are of corresponding designed to those with the same reference numerals without the double prime.

According to a fourth exemplary embodiment, which is not shown, it is possible, in a modification of the third exemplary embodiment, for the entrance-control station to dispense with the car-park-ticket-return device 20 and for the transporting duct 21" of the departure-control station to convey the car-park tickets to a level from which it is possible for an at least slightly sloping connecting duct to supply the issuing apparatus 40 of the entrance-control station 1 directly with returned car-park tickets.

The invention now being fully described, it will be apparent to one of ordinary skill in the art that many changes and modifications can be made thereto without departing from the spirit or scope of the appended claims.

What is claimed is:

1. An entrance-control and departure-control station for charge-related car parks, having an entrance-side issuing apparatus for disc-shaped car-park tickets and a departure-side retrieval apparatus for the same, having in each case one read device assigned to the issuing apparatus and to the retrieval apparatus, and having at least one control device for issuing car-park tickets to the car-park user and retrieving them from the car-park user, the issuing and retrieval apparatuses being coupled to one another via a car-park-ticket-return device which comprises a transporting duct, which guides the car-park tickets and an outlet of which adjoins the issuing apparatus, and at least one pushing device which is arranged downstream of the retrieval apparatus, and at least one ascending section of the transporting duct adjoins an outlet of the pushing device for receiving a group of car-park tickets which are located one above the other under the action of gravity and against which car-park tickets which are received by the pushing device and exert pushing movements on the respectively lowermost car-park ticket in the group can be conveyed through the transporting duct in and by means of a car-park-ticket stream, the control device switching a motor on and off in a stepwise manner for actuating the pushing device in dependence on the issuing of one or more car-park tickets.

2. An entrance-control and departure-control station according to claim 1, wherein the car-park-ticket-return device is installed in a combined entrance-control and departure-control station.

3. An entrance-control and departure-control station according to claim 1, wherein the entrance-control station comprises an independent structural unit in which the transporting duct and the pushing device are integrated, and the pushing device is connected to the retrieval apparatus via a connecting duct which bridges a spatial distance between the entrance-control station and the departure-control station.

4. An entrance-control and departure-control station according to claim 3, wherein the connecting duct is guided with a gradient to the pushing device.

5. An entrance-control and departure-control station according to claim 1, wherein the departure-control station comprises an independent structural unit in which the pushing device is integrated, and the ends of the transporting duct serve as a connecting duct for bridging a spatial distance between the entrance-control station and the departure-control station.

6. An entrance-control and departure-control station according to claim 5, wherein the connecting duct adjoins the issuing apparatus by a connecting-duct section which has a gradient.

7. An entrance-control and departure-control station according to claim 1, wherein the entrance-control station and the departure-control station each comprise individual, spaced apart structural units in which a transporting duct and a pushing device are integrated such that the outlet of the transporting duct of the departure-control station or of a connecting duct adjoins an inlet of the pushing device of the entrance-control station.

8. An entrance-control and departure-control station according to claim 1, further comprising a supply container or a downwardly directed supply shaft, in or at which the transporting duct ends, arranged upstream of the issuing apparatus.

9. An entrance-control and departure-control station according to claim 1, the retrieval apparatus comprising, at least on the outlet side, a downwardly directed shaft for the car-park tickets, the retrieval apparatus adjoining the pushing device by said shaft.

10. An entrance-control and departure-control station according to claim 1, wherein the transporting duct has dimensions which prevent the car-park tickets tipping over from an upright, rollable position as they move through the transporting duct.

11. An entrance-control and departure-control station according to claim 1, wherein the issuing apparatus and the retrieval apparatus each respectively have a downwardly directed issuing and retrieval shaft via which the car-park tickets can run, over their circumferential surface, for rolling-action issuing or collection.

12. An entrance-control and departure-control station according to claim 11, wherein the read device for reading and, if appropriate, a communication device for recording on the car-park tickets which are to be issued or retrieved are arranged along the downwardly directed issuing and retrieval shafts.

13. An entrance-control and departure-control station according to claim 12, wherein the issuing and retrieval shafts have a blocking device which blocks passage through the shaft for temporarily retaining the car-park tickets in the region of the read device.

14. An entrance-control and departure-control station according to claim 1, wherein the read device is connected to a control device for actuating a parking barrier.

15. An entrance-control and departure-control station according to claim 14, wherein the pushing device comprises a driving plate with a supply container positioned thereon.

16. An entrance-control and departure-control station according to claim 15, wherein the driving plate comprises a car-park-ticket-separating device which repeatedly conveys one car-park ticket into the transporting duct.

17. An entrance-control and departure-control station according to claim 15, wherein the driving plate comprises a rotatable car-park-ticket-intercepting and driving disc which conveys the car-park tickets separately along a curved guide path ending with a discharge section into the transporting duct.

18. An entrance-control and departure-control station according to claim 17, wherein the car-park-ticket-intercepting and driving disc comprises a perforated disc with a plurality of concentrically arranged holes, the hole diameter slightly exceeding the diameter of the car-park tickets, and the perforated disc having, on its rear side facing the guide path, guide webs which project around each hole in a mouth-like manner and have a border-side mouth opening for discharging a car-park ticket, and there being provided between two mouth openings border-side guide webs which, when the perforated disc rotates, push into the transporting shaft those car-park tickets which have dropped through one of the holes into the guide path, which are guided along the latter by means of the perforated disc and can be discharged through the mouth opening.

19. An entrance-control and departure-control station according to claim 18, wherein the mouth-like guide webs have a depth which projects at least partially into the guide path and corresponds at least to the thickness of the car-park tickets, with the result that the car-park tickets which have dropped through a respective hole can be guided, and pushed beneath the perforated disc into the discharge section, by means of the mouth-like guide web.

20. An entrance-control and departure-control station according to claim 16, wherein the car-park-ticket separating and driving device are set up in an obliquely upright manner and adjoining the transporting duct at the top end.

21. An entrance-control and departure-control station for charge-related car parks, having an entrance-side issuing apparatus for disc-shaped car-park tickets and a departure-side retrieval apparatus for the same, having in each case one read device assigned to the issuing apparatus and to the retrieval apparatus, and having at least one control device for issuing car-park tickets to the car-park user and retrieving them from the car-park user, the issuing and retrieval apparatuses being coupled to one another via a car-park-ticket-return device which comprises a transporting duct, which guides the car-park tickets and an outlet of which adjoins the issuing apparatus, and at least one pushing device which is arranged downstream of the retrieval apparatus, and at least one ascending section of the transporting duct adjoins an outlet of the pushing device for receiving a group of car-park tickets which are located one above the other under the action of gravity and against which car-park tickets which are received by the pushing device and exert pushing movements on the respectively lowermost car-park ticket in the group can be conveyed through the transporting duct in and by means of a car-park-ticket stream, said pushing device comprises a driving plate with a supply container positioned thereon, the driving plate comprising a rotatable car-park-ticket-intercepting and driving disc which conveys the car-park tickets separately along a curved guide path ending with a discharge section into the transporting duct, the car-park-ticket-intercepting and driving disc comprises a perforated disc with a plurality of concentrically arranged holes, the hole diameter slightly exceeding the diameter of the car-park tickets, and the perforated disc having, on its rear side facing the guide path, guide webs which project around each hole in a mouth-like manner and have a border-side mouth opening for discharging a car-park ticket, and there being provided between two mouth openings border-side guide webs which, when the perforated disc rotates, push into the transporting shaft those car-park tickets which have dropped through one of the holes into the guide path, which are guided along the latter by means of the perforated disc and can be discharged through the mouth opening.

22. An entrance-control and departure-control station according to claim 21, wherein the car-park-ticket-return device is installed in a combined entrance-control and departure-control station.

23. An entrance-control and departure-control station according to claim 21, wherein the entrance-control station comprises an independent structural unit in which the transporting duct and the pushing device are integrated, and the pushing device is connected to the retrieval apparatus via a connecting duct which bridges a spatial distance between the entrance-control station and the departure-control station.

24. An entrance-control and departure-control station according to claim 23, wherein the connecting duct is guided with a gradient to the pushing device.

25. An entrance-control and departure-control station according to claim 21, wherein the departure-control station comprises an independent structural unit in which the pushing device is integrated, and the ends of the transporting duct serve as a connecting duct for bridging a spatial distance between the entrance-control station the departure-control station.

26. An entrance-control and departure-control station according to claim 25, wherein the connecting duct adjoins the issuing apparatus by a connecting-duct section which has a gradient.

27. An entrance-control and departure-control station according to claim 25, wherein the entrance-control station and the departure-control station each comprise individual, spaced apart structural units in which a transporting duct and a pushing device are integrated such that the outlet of the transporting duct of the departure-control station or of a connecting duct adjoins an inlet of the pushing device of the entrance-control station.

28. An entrance-control and departure-control station according to claim 21, further comprising a supply container or a downwardly directed supply shaft, in or at which the transporting duct ends, arranged upstream of the issuing apparatus.

29. An entrance-control and departure-control station according to claim 21, the retrieval apparatus comprising, at least on the outlet side, a downwardly directed shaft for the car-park tickets, the retrieval apparatus adjoining the pushing device by said shaft.

30. An entrance-control and departure-control station according to claim 21, wherein the transporting duct has dimensions which prevent the car-park tickets tipping over from an upright, rollable position as they move through the transporting duct.

31. An entrance-control and departure-control station according to claim 21, wherein the issuing apparatus and the retrieval apparatus each respectively have a downwardly directed issuing and retrieval shaft via which the car-park tickets can run, over their circumferential surface, for rolling-action issuing or collection.

32. An entrance-control and departure-control station according to claim 31, wherein the read device for reading and, if appropriate, a communication device for recording on the car-park tickets which are to be issued or retrieved are arranged along the downwardly directed issuing and retrieval shafts.

33. An entrance-control and departure-control station according to claim 32, wherein the issuing and retrieval shafts have a blocking device which blocks passage through the shaft for temporarily retaining the car-park tickets in the region of the read device.

34. An entrance-control and departure-control station according to claim 21, wherein the read device is connected to a control device for actuating a parking barrier.

35. An entrance-control and departure-control station according to claim 21, wherein the driving plate comprises a car-park-ticket-separating device which repeatedly conveys one car-park ticket into the transporting duct.

36. An entrance-control and departure-control station according to claim 21, wherein the mouth-like guide webs have a depth which projects at least partially into the guide path and corresponds at least to the thickness of the car-park tickets, with the result that the car-park tickets which have dropped through a respective hole can be guided, and pushed beneath the perforated disc into the discharge section, by means of the mouth-like guide web.

37. An entrance-control and departure-control station according to claim 35, wherein the car-park-ticket separating and driving device are set up in an obliquely upright manner and adjoining the transporting duct at the top end.

38. An entrance-control and departure-control station according to claim 21, wherein the control device switches a motor on and off in a stepwise manner for actuating the pushing device in dependence on the issuing of one car-park ticket.

39. An entrance-control and departure-control station for charge-related car parks, having an entrance-side issuing apparatus for disc-shaped car-park tickets having an identification element with a selectable code and a departure-side retrieval apparatus for the same, having in each case one read device assigned to the issuing apparatus and to the retrieval apparatus, and having at least one control device for issuing car-park tickets to a car-park user and retrieving them from the car-park user, the issuing and retrieval apparatuses being coupled to one another via a car-park-ticket-return device, said retrieval apparatus distinguishing between car-park tickets which are authorized for departure and those which are not authorized for departure by reading said identification element and directing the tickets for not authorized departure to a reject device while tickets for authorized departure are guided to said car-park-ticket-return device which comprises a transporting duct, which guides the car-park tickets and an outlet of which adjoins the issuing apparatus, and at least one pushing device which is arranged downstream of the retrieval apparatus, and at least one ascending device for receiving a group of car-park tickets which are located one above the other under the action of gravity, the pushing device receiving car-park tickets and exerting pushing movement on the lowermost car-park ticket in the group, which lower-most car-park ticket is conveyed through the transporting duct by means of a car-park-ticket stream.

40. An entrance-control and departure-control station according to claim 39, wherein said disc-shaped car-park tickets comprise a communication element.

41. An entrance-control and departure-control station according to claim 39, wherein the car-park-ticket-return device is installed in a combined entrance-control and departure-control station.

42. An entrance-control and departure-control station according to claim 39, wherein the entrance-control station comprises an independent structural unit in which the transporting duct and the pushing device are integrated, and the pushing device is connected to the retrieval apparatus via a connecting duct which bridges a spatial distance between the entrance-control station and the departure-control station.

43. An entrance-control and departure-control station according to claim 42, wherein the connecting duct is guided with a gradient to the pushing device.

44. An entrance-control and departure-control station according to claim 39, wherein the departure-control station comprises an independent structural unit in which the pushing device is integrated, and the ends of the transporting duct serve as a connecting duct for bridging a spatial distance between the entrance-control station and the departure-control station.

45. An entrance-control and departure-control station according to claim 44, wherein the connecting duct adjoins the issuing apparatus by a connecting-duct section which has a gradient.

46. An entrance-control and departure-control station according to claim 39, wherein the entrance-control station and the departure-control station each comprise individual, spaced apart structural units in which a transporting duct and a pushing device are integrated such that the outlet of the transporting duct of the departure-control station or of a connecting duct adjoins an inlet of the pushing device of the entrance-control station.

47. An entrance-control and departure-control station according to claim 39, further comprising a supply container or a downwardly directed supply shaft, in or at which the transporting duct ends, arranged upstream of the issuing apparatus.

48. An entrance-control and departure-control station according to claim 39, the retrieval apparatus comprising, at least on the outlet side, a downwardly directed shaft for the car-park tickets, the retrieval apparatus adjoining the pushing device by said shaft.

49. An entrance-control and departure-control station according to claim 39, wherein the transporting duct has dimensions which prevent the car-park tickets tipping over from an upright, rollable position as they move through the transporting duct.

50. An entrance-control and departure-control station according to claim 39, wherein the issuing apparatus and the retrieval apparatus each respectively have a downwardly directed issuing and retrieval shaft via which the car-park tickets can run, over their circumferential surface, for rolling-action issuing or collection.

51. An entrance-control and departure-control station according to claim 50, wherein the read device for reading and, if appropriate, a communication device for recording on the car-park tickets which are to be issued or retrieved are arranged along the downwardly directed issuing and retrieval shafts.

52. An entrance-control and departure-control station according to claim 51, wherein the issuing and retrieval shafts have a blocking device which blocks passage through the shaft for temporarily retaining the car-park tickets in the region of the read device.

53. An entrance-control and departure-control station according to claim 39, wherein the read device is connected to a control device for actuating a parking barrier.

54. An entrance-control and departure-control station according to claim 53, wherein the pushing device comprises a driving plate with a supply container positioned thereon.

55. An entrance-control and departure-control station according to claim 54, wherein the driving plate comprises a car-park-ticket-separating device which repeatedly conveys one car-park ticket into the transporting duct.

56. An entrance-control and departure-control station according to claim 54, wherein the driving plate comprises a rotatable car-park-ticket-intercepting and driving disc which conveys the car-park tickets separately along a curved guide path ending with a discharge section into the transporting duct.

57. An entrance-control and departure-control station according to claim 56, wherein the car-park-ticket-intercepting and driving disc comprises a perforated disc with a plurality of concentrically arranged holes, the hole diameter slightly exceeding the diameter of the car-park tickets, and the perforated disc having, on its rear side facing the guide path, guide webs which project around each hole in a mouth-like manner and have a border-side mouth opening for discharging a car-park ticket, and there being provided between two mouth openings border-side guide webs which, when the perforated disc rotates, push into the transporting shaft those car-park tickets which have dropped through one of the holes into the guide path, which are guided along the latter by means of the perforated disc and can be discharged through the mouth opening.

58. An entrance-control and departure-control station according to claim 57, wherein the mouth-like guide webs have a depth which projects at least partially into the guide path and corresponds at least to the thickness of the car-park tickets, with the result that the car-park tickets which have dropped through a respective hole can be guided, and pushed beneath the perforated disc into the discharge section, by means of the mouth-like guide web.

59. An entrance-control and departure-control station according to claim 55, wherein the car-park-ticket separating and driving device are set up in an obliquely upright manner and adjoining the transporting duct at the top end.

60. An entrance-control and departure-control station according to claim 39, wherein the control device switches a motor on and off in a stepwise manner for actuating the pushing device in dependence on the issuing of one or more car-park tickets.

* * * * *